United States Patent [19]

Juhasz

[11] Patent Number: 4,576,379

[45] Date of Patent: Mar. 18, 1986

[54] SOCCER PRACTICE APPARATUS

[76] Inventor: Istvan Juhasz, 6578 Bell Bluff Ave., San Diego, Calif. 92119

[21] Appl. No.: 604,372

[22] Filed: Apr. 26, 1984

[51] Int. Cl.[4] ..... A63B 69/00

[52] U.S. Cl. ..... 273/411; 273/58 C; 273/413

[58] Field of Search ..... 273/411, 413, 58 C, 273/26 E, 29 A

[56] References Cited

U.S. PATENT DOCUMENTS

| | | | |
|---|---|---|---|
| 1,345,789 | 7/1920 | Linley | 273/413 |
| 3,166,317 | 1/1965 | Tumelson | 273/26 E |
| 4,191,372 | 3/1980 | Keller | 273/29 A |
| 4,278,257 | 7/1981 | Garcia et al. | 273/411 |
| 4,462,599 | 7/1984 | Brown | 273/411 |

*Primary Examiner*—William H. Grieb

*Attorney, Agent, or Firm*—Thomas I. Rozsa

[57] ABSTRACT

The present invention relates to an apparatus which enables an individual to practice the game of soccer when by himself and without assistance from others.

The present invention provides an apparatus which enables a person to kick a soccer ball and have the ball automatically returned to him for frequent re-kicks. In addition, upon the return kicks, the ball will be traveling at some speed to simulate the travel of a ball during a soccer game.

The present invention also provides an apparatus which enables a person to hit the soccer ball with another part of his body, such as his head, and also have the ball automatically returned to him for frequent re-hits. Once again, upon the return, the ball will be traveling at some speed which simulates conditions during a soccer game.

2 Claims, 1 Drawing Figure

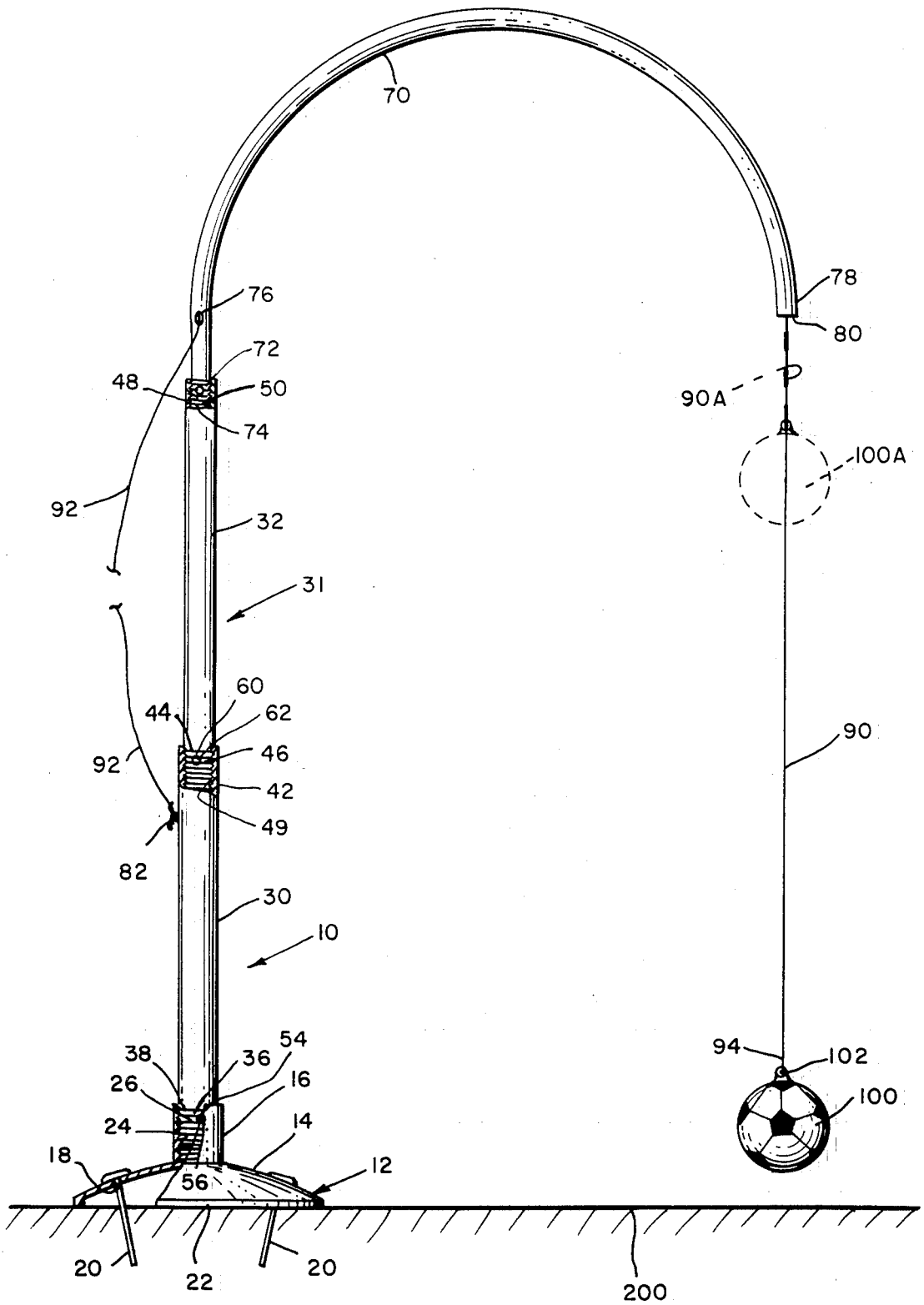
70
76
72
48
50
74
92
32
31
60
44
62
46
92
42
49
82
30
10
38
36
54
26
16
24
14
18
12
56
20
22
20
200
78
80
90A
100A
90
94
102
100

SOCCER PRACTICE APPARATUS

BACKGROUND OF THE INVENTION

1. Field of the Invention

The present invention relates to a sporting goods apparatus which can be used to practice the sport of soccer. The apparatus is in the general field of sporting goods and can also be used for playing a ball type game.

2. Description of the Prior Art

Soccer is a game played on a field between two teams of eleven players each, with the object to propel a round ball into the opponent's goal by kicking or by hitting it with any part of the body except the hands and arms. In practicing the game by oneself, the player practices kicking the ball or otherwise causing the ball to move, such as hitting it with his head. Conventional soccer practice apparatus to assist in training a player to kick a ball involves a tee upon which a ball is placed and possibly a net into which the ball may be kicked. Often times, the ball is simply on the ground and is kicked. While this method enables a player to practice kicking the ball, it is not very effective, because the ball can travel for a long distance after it is kicked, thereby necessitating frequent running after the kicked ball. If the practice field is adjacent a roadway, this provides the additional hazard of having the ball kicked into the street. This poses a danger to both the vehicles and to the player who has to run into the street to retrieve the ball. There is no prior art which allows the player to kick the ball and will permit the ball to be returned to its intitial position for numerous re-kicks without the necessity of running after the ball to retrieve it.

In addition, the only way known in the prior art for a player to practice hitting the ball with another part of his body such as his head is to throw the ball in the air and wait for it to fall into alignment with his head before hitting it. First, this once again creates the situation where the ball can travel for a long distance, with the attendant problems previously set forth. In addition, merely throwing the ball in the air does not simulate actual playing conditions where the ball is traveling in the air in the direction of the player at some speed.

The closest prior art apparatus to the present invention is a game called tetherball. In that game, a pole is placed into the ground so that it projects vertically upward. One end of a rope is attached adjacent the top of the pole and the other end is tied to a ball which hangs from the rope. In a non-used position, the ball abuts the pole at some distance along its vertical length. Two players stand on opposite sides of the pole and bat the ball back and forth. The object is to bat the ball over the opposing player's head on several turns around the pole so that the rope is entirely wrapped around the pole. Since the ball lies limp in its at-rest position, and is elevated some distance above the ground, it is not practical to kick the ball. Even if the ball were lowered to the ground, due to its proximity to the pole, a player could easily kick into the pole and injure his foot. For the same reason, it is not practical to hit the ball with another part of the body such as the head, since the player's head could also easily hit the pole Therefore, the closest prior art, namely the tetherball game, is totally impractical for use as a soccer practice apparatus.

Therefore, there is no apparatus known in the prior art which provides an effective way to practice the game of soccer by oneself in a confined area or in an area where the ball can travel for a great distance.

SUMMARY OF THE PRESENT INVENTION

The present invention relates to an apparatus which enables an individual to practice the game of soccer when by himself and without assistance from others.

The present invention provides an apparatus which enables a person to kick a soccer ball and have the ball automatically returned to him for frequent re-kicks. In addition, upon the return kicks, the ball will be traveling at some speed to simulate the travel of a ball during a soccer game.

The present invention also provides an apparatus which enables a person to hit the soccer ball with another part of his body, such as his head, and also have the ball automatically returned to him for frequent re-hits. Once again, upon the return, the ball will be traveling at some speed which simulates conditions during a soccer game.

It has been discovered, according to the present invention, that if a structure composed of a pole supported by a base is connected to a structure composed of a hollow, rigid, arcuate member which contains a chord, chain or comparable device whose length emanating from the open end of the hollow, rigid, arcuate member can be varied, then a ball, such as a soccer ball, can be secured to the free end of the chain, rope or comparable device, and suspended at any multiplicity of heights from the ground. Through use of this apparatus, the ball can be suspended only a short distance above the ground so that it can be kicked, or suspended at varying heights above the ground so that it can be hit with the chest or head of an individual.

It has also been discovered that an apparatus as described above can be used to safely practice the game of soccer by kicking or hitting the ball at a distance safely away from the supporting pole.

It has further been discovered, according to the present invention, that an apparatus as described above provides a means for assuring that the kicked ball will be automatically returned to the player without the necessity of chasing after the ball. In addition, the apparatus will enable the kicked or hit ball to return toward the player with a degree of speed, to further simulate game conditions played during the game of soccer.

It has additionally been discovered that an apparatus as described above can also be used for playing a ball type game such as kicking or hitting a ball with the assurance that it will always return to its original position for subsequent kicks and hits.

It is therefore an object of the present invention to provide an apparatus which provides a safe and efficient way to practice kicking a ball and hitting a ball with other parts of the body as the ball would be kicked or hit during a game of soccer.

It is another object of the present invention to provide an apparatus which simulates the way a ball would travel during the game conditions in a game of soccer so that an individual can more effectively practice kicking and hitting the ball.

It is a further object of the present invention to provide an apparatus which enables a player to kick or hit a ball and assures that the ball will always return to its original position, to thereby eliminate the requirement of chasing after a kicked or hit ball which has traveled a substantial distance.

It is still another object of the present invention to provide an apparatus which enables an individual to practice the game of soccer by himself and to adjust the ball's height so that the individual can practice kicking and hitting the ball with various parts of his body.

Further novel features and other objects of the present invention will become apparent from the following detailed description, discussion and the appended claims, taken in conjunction with the drawing.

DRAWING SUMMARY

Referring particularly to the drawing for the purpose of illustration only and not limitation there is illustrated:

The FIGURE is a perspective view of the present invention showing the ball at an elevation slightly above the ground and also showing in phantom the ball at an elevation which would be at the height of a man's head.

DETAILED DESCRIPTION OF THE PREFERRED EMBODIMENT

Although specific embodiments of the invention will now be described with reference to the drawing, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

In general concept, the present invention includes a generally vertically disposed support member which is supported at ground level at one end and in turn supports an arcuate hollow member at its other end. The front end of said arcuate hollow member extends generally away from said generally vertically disposed support member and also extends toward the ground. The hollow arcuate member contains a chord, chain or the like ball height adjustment means, which extends through the arcuate member and exits therefrom at an opening in its front end. This end of the chord, chain, etc. is secured to a ball such as a soccer ball while the other end is tied to a location on the support member of the pole. The length of chord can be increased or decreased to vary the position of the ball relative to the ground to thereby bring it into positon to be either kicked with the foot or hit by another part of the body, such as the knee, the chest or the head. The arcuate hollow member is sufficiently large to assure that the support pole is well away from the hung ball, thereby removing the possibility of the player accidentally kicking or hitting the supporting pole while kicking or hitting the ball.

The preferred embodiment of the present invention is illustrated in the FIGURE. The soccer practice apparatus is generally designated at 10. The apparatus 10 includes a support means 12 which has a lower base section 14 and upper stand section 16. In one embodiment, the base section 14 can be made of very heavy material, such as iron, in order to give it sufficient strength to remain level when forces are indirectly imparted to it. Alternatively, the base 12 can be hollow and filled with sand in order to give it weight. In the preferred embodiment, the base 14 contains a multiplicity of openings 18 which extend vertically through the base 14 and into which are inserted dowels or pegs 20 which are hammered into the ground 200 to retain the base 14. Through the latter apparatus, the base section 14 can be light to facilitate ease of transportation. By way of example, the lower surface 22 of base 14 can be circular and have a radius of twenty-five (25) centimeters. As shown in the FIGURE, the support means 12 further contains a stand section 16 which emanates from the top of the base section 14 and extends in a vertical direction. In the prefered embodiment, the stand section 16 is cylindrical and is hollow. The interior wall 24 of stand section 16 contains a multiplicity of screw threads 26. By way of example, the stand section can be approximately five centimeters high. The support means supports either one or a multiplicity of support poles. The illustration in the FIGURE shows the support pole 31 in two pole sections 30 and 32. By way of example, each pole section, 30 or 32, can be approximately 122 centimeters long and can have an outer diameter of approximately 4–5 centimeters. It is emphasized that the present invention incorporates one or more such support pole sections. Each support pole contains a male threaded surface at one end and a female threaded internal surface at its other end so that the lowermost pole can be screwed into the stand section 16 of base 12 and subsequent poles can be screwed into the next lowermost pole. In the illustration in the FIGURE, pole section 30 contains screw threads 36 in a reduced diameter forward end 38 which screws into the threads 26 in stand section 16. Pole section 30 also contains internal threads 49 at its other end 42. Similarly, pole section 32 contains external threads 44 on its reduced diameter end 46 which screw into threads 49 in pole 30. And pole section 32 contains internal threads 48 at its end 50. While the interconnections of the poles have been described as being screwed into each other, it is emphasized that this is only one interconnecting means and other interconnections between the lowermost pole and the stand and the other poles such as a press fit are also within the spirit and scope of the present invention. In addition, as further security, the surfaces of each pole section adjacent its ends can contain an opening which is aligned with an opening in an adjoining pole section or the stand, through which a lock pin can be inserted. For example, stand section 16 may contain an opening 54 which is aligned with an opening (not shown) in the forward end of pole section 30 with lock pin 56 inserted therethrough. Similarly, the surface of the other end of pole section 30 contains an opening 60 which is aligned with an opening (not shown) in the surface of pole section 32 so that the lock pin 62 can be inserted therethrough. Although it is not necessary, it is preferred that the pole section be hollow to reduce the weight.

The vertically disposed support pole 31 in turn supports an arcuate member 70 which is hollow. The arcuate member can be in one section, as shown in the FIGURE. Alternatively, it can be formed from a multiplicity of sections, as with the pole, which are placed together so as to form the arcuate shape. The method of interconnection can be as described for the vertical pole, namely being screwed together and further supported by a lock pin placed through aligned holes in adjoining surfaces. The end 72 of hollow arcuate member 70 is interconnected to the top of pole 31 at the end 50 of pole section 32. As before, end 72 can contain threads 74 in a reduced diameter surface which screw into threads 48 in pole section 76. The forward end 78 of arcuate member 70 is open. The opening is designated at 80.

Ending through the interior of the arcuate member 70 is a ball height adjustment means 90. In the preferred embodiment, the ball height adjustment means 90 is a strong rope, but other devices such as a chord, a chain or other elongated flexible means are certainly within the spirit and scope of the present invention. For purposes of the following discussion, we will refer to flexible height adjustment means 90 as rope 90. At its rear section 92, rope 90 extends out of opening 76 in arcuate member 70 and can be fastened to hook 82 which is located on the surface of one of the pole sections. At its forward section, rope 90 extends out of opening 80 in arcuate member 70. A ball such as a soccer ball 100 to which attachment means such as a ring or loop 102 is rigidly attached is then secured to the front end 94 of rope 90. The height of the soccer ball 100 above the ground can be easily adjusted by pulling on the rear end 92 of rope 90 and fastening the rope at a different location on hook 82. In the illustration in the FIGURE, the solid rope 90 and ball 100 show the ball 100 at a location adjacent to ground 200. Shown in phantom, is the rope 90A and ball 100A at an elevated location generally in line with another part of the player's body such as his head.

By way of example only, the horizontal distance from the rear end 72 to the front end 78 of the arcuate member 70 can be approximately 110 centimeters. This will provide a sufficient distance between the ball 100 and the pole 31 to assure that the player will not accidentally kick the pole when he kicks the ball 100 or hits the pole 31 with another part of his body such as his head when he bats the ball with his head.

Due to the flexibility of the rope 90, after the ball is kicked or hit, it will travel in the direction away from the player until it has reached its maximum arc, at which time it swings in a return direction. Therefore, the ball 100 will be traveling toward the player at some speed which simulates the game conditions.

Due to the adjustment of ball height at any desired position above the ground, any person of any height can practice the game of soccer with the present invention and can practice hitting the ball with any desired part of his body while he is in any multiplicity of positions such as standing, squatting, bent over, etc.

Therefore, the present invention provides a safe and efficient apparatus which facilitates the practice of all the types of kicks and hits on the ball during the game of soccer and which is designed to enable anyone to practice in any position.

It is emphasized that the dimensions provided for the parts is only one such set and any multiplicity of dimensions is within the scope and spirit of the present invention. For example, pole section 32 could be approximately 90 centimeters instead of approximately 122 centimeters to more readily facilitate use by a child rather than an adult.

Of course, the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. A soccer practice apparatus comprising:

a. a generally vertically disposed support member which is supported at ground level at its lowermost end;

b. said generally vertically disposed support member further comprising a multiplciity of sections which are interconnected at adjoining ends;

c. said generally vertically disposed support member being supported at its lowermost end by a base which is removably secured to the ground;

d. a continuously curved arcuate hollow member having its rear end supported at the opposite end of said generally vertically disposed support member;

e. said continuously curved arcuate hollow member further comprising a multiplicity of interconnected sections;

f. the front end of said continuously curved arcuate hollow member extending away from said generally vertically disposed support member;

g. the front end of said continuously curved arcuate hollow member being open and extending generally toward the ground;

h. a ball height adjustment means supported through said continuously curved arcuate hollow member and having its front end extending through the opening at the front end of said continuously curved arcuate hollow member;

i. the front tip of said ball height adjustment means being secured to a soccer ball;

j. the rear portion of said ball height adjustment means extending through an opening in the surface of said hollow arcuate member and being secured to a location on said generally vertically disposed support member at any multiplciity of locations along the length of said ball height adjustment means; and k. said continuously curved arcuate hollow member extending for a horizontal arc length of at least 110 centimeters;

l. whereby the height at which said ball is extended above the ground can be adjusted by varying the location along the length of said ball height adjustment means where it is secured to said vertically disposed support member, said soccer ball is permitted to hang freely in the air at any multiplicity of locations above the ground, and said soccer ball is suspended at a sufficient horizontal distance from said vertically disposed support member to permit a user to safely kick said soccer ball with the foot or hit said soccer ball with his head or chest without incurring a risk of accidentally hitting said vertically disposed support member.

2. The invention as defined in claim 1 wherein said ball height adjustment means is a rope.

* * * * *